US007726586B2

(12) United States Patent
Murai et al.

(10) Patent No.: US 7,726,586 B2
(45) Date of Patent: Jun. 1, 2010

(54) ROTARY ATOMIZING HEAD AND ROTARY ATOMIZING COATING MACHINE

(75) Inventors: Masaru Murai, Toyota (JP); Makoto Ichimura, Toyota (JP)

(73) Assignees: Toyota Jidosha Kabushiki Kaisha, Toyota-Shi (JP); Trinity Industrial Corporation, Toyota-Shi (JP)

( * ) Notice: Subject to any disclaimer, the term of this patent is extended or adjusted under 35 U.S.C. 154(b) by 104 days.

(21) Appl. No.: 11/666,423

(22) PCT Filed: Nov. 7, 2005

(86) PCT No.: PCT/JP2005/020767

§ 371 (c)(1),
(2), (4) Date: Jun. 1, 2007

(87) PCT Pub. No.: WO2006/049341

PCT Pub. Date: May 11, 2006

(65) Prior Publication Data

US 2007/0290081 A1 Dec. 20, 2007

(30) Foreign Application Priority Data

Nov. 8, 2004 (JP) ..... 2004-323059

(51) Int. Cl.
*B05B 3/10* (2006.01)

(52) U.S. Cl. ..... 239/224; 239/222.11; 239/223; 118/323

(58) Field of Classification Search ..... 118/323; 239/222.11, 223, 224, 500, 502, 700, 703
See application file for complete search history.

(56) References Cited

U.S. PATENT DOCUMENTS

| | | | | | |
|---|---|---|---|---|---|
| 4,225,084 | A | * | 9/1980 | Bals | 239/223 |
| 4,369,924 | A | * | 1/1983 | Morishita et al. | 239/223 |
| 4,518,119 | A | * | 5/1985 | Vetter | 239/223 |
| 4,684,064 | A | * | 8/1987 | Kwok | 239/223 |
| 4,784,332 | A | * | 11/1988 | Takeuchi et al. | 239/222.11 |
| 4,919,333 | A | * | 4/1990 | Weinstein | 239/223 |
| 5,078,321 | A | * | 1/1992 | Davis et al. | 239/224 |
| 5,152,458 | A | * | 10/1992 | Curtis | 239/224 |
| 5,788,165 | A | * | 8/1998 | Sakakibara et al. | 239/700 |
| 5,909,849 | A | * | 6/1999 | Yamasaki et al. | 239/700 |

(Continued)

FOREIGN PATENT DOCUMENTS

EP 0 161 184 A1 11/1985

(Continued)

*Primary Examiner*—Steven J Ganey
(74) *Attorney, Agent, or Firm*—Oliff & Berridge PLC

(57) ABSTRACT

The purpose of the present invention is to provide a rotary atomizing head that paint supplied to an inner peripheral surface is spread on the inner peripheral surface uniformly so as to improve the quality of coating and to lengthen the life of the rotary atomizing head. An inner peripheral surface 67 diametrically expanded from the center of the rotary atomizing head to a peripheral edge 61*b* is formed and centrifugal force generated by the rotation is applied on the paint supplied to the inner peripheral surface 67 so as to discharge the paint outside atomizingly. A step part 68 is formed at the middle portion of the inner peripheral surface 67 between paint supply holes 65*d*, supplying paint or solvent to the inner peripheral surface 67, and the peripheral edge 61*b* of the inner peripheral surface 67.

4 Claims, 4 Drawing Sheets

U.S. PATENT DOCUMENTS 5,934,574 A * 8/1999 van der Steur ..... 239/700

FOREIGN PATENT DOCUMENTS

| | | |
|---|---|---|
| EP | 1 759 771 A1 | 3/2007 |
| JP | A-57-042361 | 3/1982 |
| JP | A 57-174170 | 10/1982 |
| JP | A 3-101858 | 4/1991 |
| JP | A-8-24719 | 1/1996 |
| JP | A 8-84941 | 4/1996 |
| JP | A-8-173857 | 7/1996 |
| JP | A 9-220498 | 8/1997 |

* cited by examiner (A)

(B)

(A)

(B)

(C)

ROTARY ATOMIZING HEAD AND ROTARY ATOMIZING COATING MACHINE

TECHNICAL FIELD OF THE INVENTION

The present invention relates to a rotary atomizing head or a rotary atomizing coating machine having a rotary atomizing head.

BACKGROUND ART

Conventionally, there is well known a rotary atomizing head or a rotary atomizing coating machine having a rotary atomizing head. The rotary atomizing head is a cup-like or trumpet-like member which is called bell cup. Paint supply holes are formed in the inner peripheral surface of the rotary atomizing head so as to supply paint. The paint supply holes are normally circular holes or oval holes and are arranged circumferentially so that the distance between each paint supply hole and the center of the inner peripheral surface of the rotary atomizing head is substantially equal to each other. The rotary atomizing head applies centrifugal force on the paint supplied to the inner peripheral surface by rotating itself so as to discharge the paint outside atomizingly.

Such a rotary atomizing head is disclosed in the Japanese Patent Laid Open Gazette Hei. 9-220498, the Japanese Patent Laid Open Gazette Hei. 8-84941 and the Japanese Patent Laid Open Gazette Hei. 3-101858 for instance.

However, when the rotary speed of the rotary atomizing head is increased or viscosity of paint is high, paint supplied to the inner peripheral surface of the rotary atomizing head is moved within quite shallow parts on lines connecting the paint supply holes to the corresponding points on the peripheral edge of the inner peripheral surface, and is not spread on the inner peripheral surface of the rotary atomizing head uniformly. As a result, when the paint is discharged outside atomizingly from the peripheral edge, the particle size of the paint is not uniform, thereby deteriorating the quality of coating.

When the hardness of pigment included in the paint is high, the specific parts of the inner peripheral surface of the rotary atomizing head on which the paint moves wear out. As a result, it is difficult to lengthen the life of the rotary atomizing head.

Furthermore, the paint may be contaminated with wearing powder generated by the wearing of the rotary atomizing head and then painted on a coated surface of a coated thing so as to cause the failure of paint.

In consideration of above-mentioned circumstances, the present invention provides a rotary atomizing head that paint supplied to an inner peripheral surface is spread on the inner peripheral surface uniformly so as to improve the quality of coating and to lengthen the life of the rotary atomizing head and a rotary atomizing coating machine comprising the rotary atomizing head.

SUMMARY OF THE INVENTION

The above-mentioned problems are solved by the following means.

According to the present invention, with regard to a rotary atomizing head that an inner peripheral surface diametrically expanded from a center of the rotary atomizing head to a peripheral edge is formed and centrifugal force generated by rotation is applied on paint supplied to the inner peripheral surface so as to discharge the paint outside atomizingly, a step part is provided at a middle portion of the inner peripheral surface between paint supply holes, supplying paint to the inner peripheral surface, and the peripheral edge of the inner peripheral surface, the step part comprises a step surface preferably substantially perpendicular to a direction of centrifugal force applied on the paint supplied to the inner peripheral surface, and a distance between each of the paint supply holes and the step part is shorter than a distance between the step part and the peripheral edge.

According to the present invention, the step part comprises a step surface preferably substantially perpendicular to a direction of centrifugal force applied on the paint supplied to the inner peripheral surface.

According to the present invention, with regard to a rotary atomizing coating machine comprising a rotary atomizing head that an inner peripheral surface diametrically expanded from a center of the rotary atomizing head to a peripheral edge is formed and centrifugal force generated by rotation is applied on paint supplied to the inner peripheral surface so as to discharge the paint outside atomizingly, a step part is provided at a middle portion of the inner peripheral surface between paint supply holes, supplying paint to the inner peripheral surface, and the peripheral edge of the inner peripheral surface, the step part comprises a step surface preferably substantially perpendicular to a direction of centrifugal force applied on the paint supplied to the inner peripheral surface, and a distance between each of the paint supply holes and the step part is shorter than a distance between the step part and the peripheral edge.

According to the present invention, the step part comprises a step surface preferably substantially perpendicular to a direction of centrifugal force applied on the paint supplied to the inner peripheral surface.

The present invention brings below effects.

The present invention improves the quality of coating and lengthens the life of the rotary atomizing head.

According to the present invention, paint is certainly dammed up once so as to spread the paint on the inner peripheral surface uniformly.

BEST MODE FOR CARRYING OUT THE INVENTION

An entire construction of a rotary atomizing coating machine 1 having a rotary atomizing head 6 according to an embodiment of the present invention will be described with reference to FIG. 1.

Figure 1:
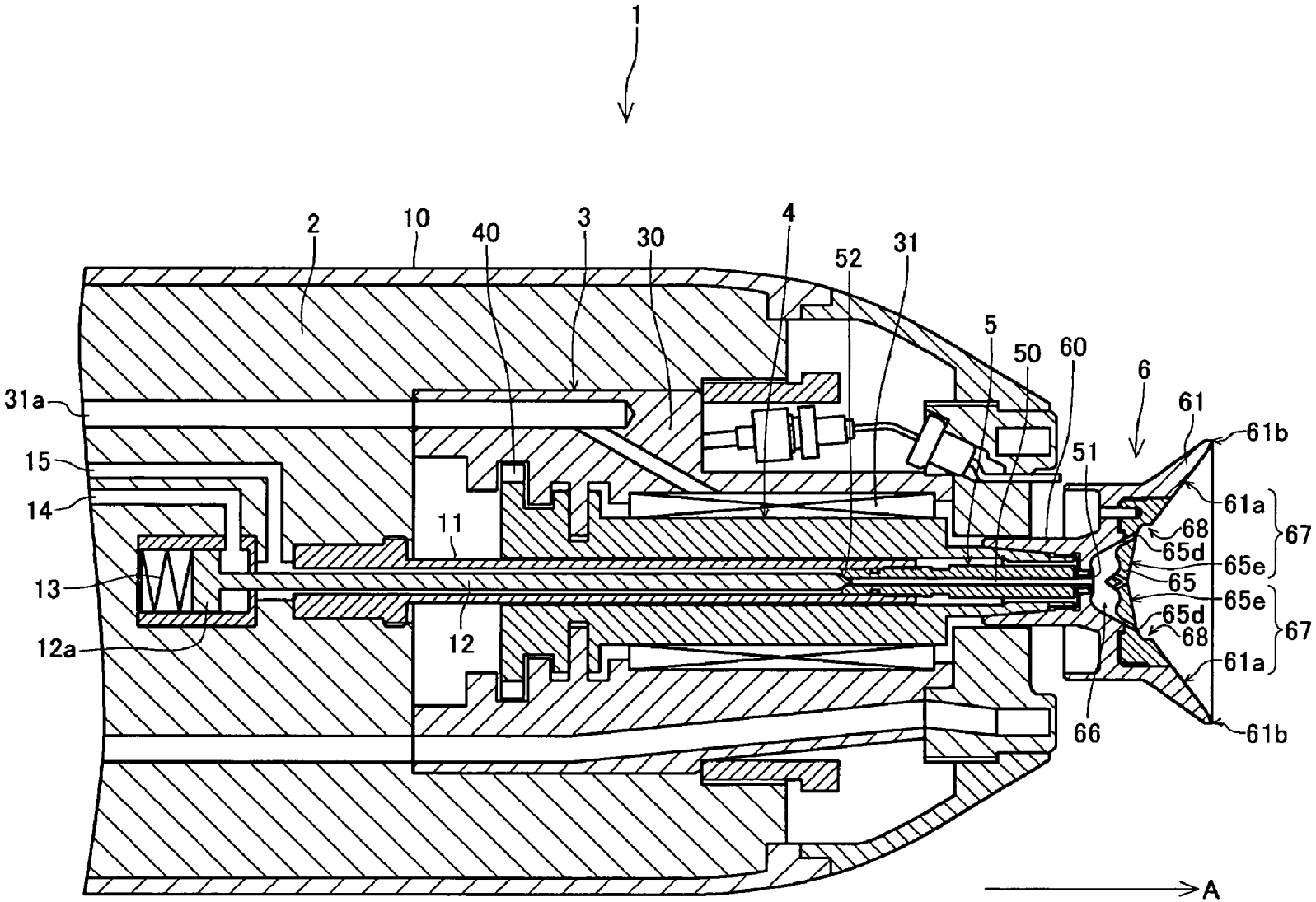
FIG. 1 is a sectional side view of a rotary atomizing coating machine according to an embodiment of the present invention.

In addition, in the following description, the direction of an arrow A in FIG. 1 is defined as "the forward direction". The arrow A is substantially in parallel to the axial direction of a later-discussed rotary shaft 4.

Figure 4:
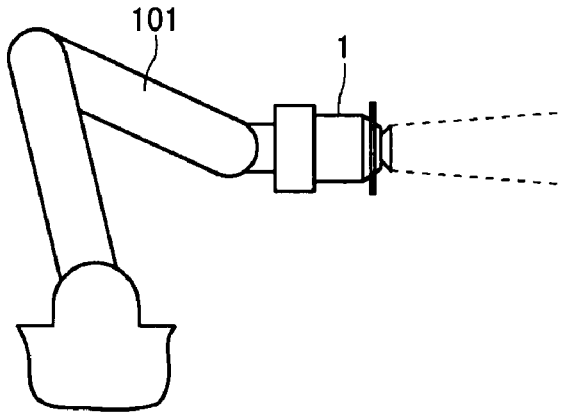
FIG. 4 is a schematic drawing of the working state of the rotary atomizing coating machine.
Figure 4:
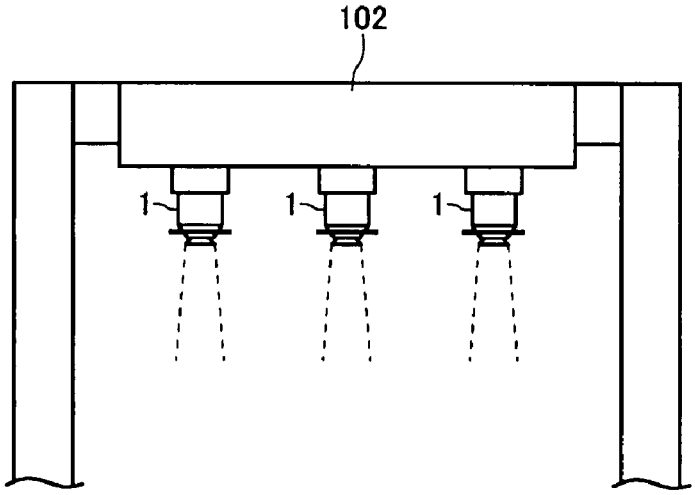
Figure 4:
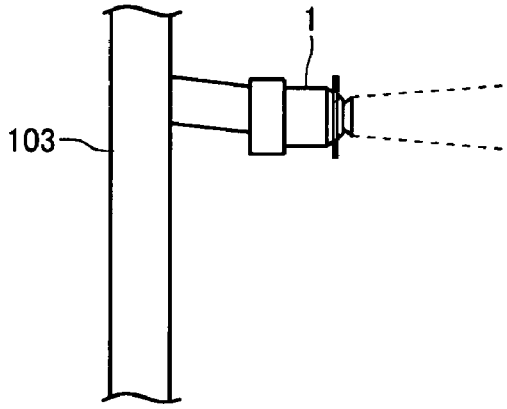

The coating machine 1 sprays atomized paint to coat a target (for example, a body of a car or a housing of a electric household appliance). For example, as shown in (A), (B) and (C) in FIG. 4, the coating machine 1 is used while being fixed to a tip part of an articulated robot 101, an upper part of a gate-shaped stay 102, or a middle part of a stay 103.

"Paint" in this application includes oil paint, water paint and the other kinds of paint widely.

As shown in FIG. 1, the coating machine 1 mainly comprises a main body 2, a motor 3, the rotary shaft 4, the paint supply tube 5 and a rotary atomizing head 6.

The main body 2 is a structural member of the coating machine 1 and contains the motor 3. The main body 2 also serves as a support member for fixing the coating machine 1 to an articulated robot or a stay and supporting the coating machine 1. An outer peripheral surface of the main body 2 is covered by a cover 10 which is a substantially circular cylindrical member. The main body 2 also contains a high voltage generator (not shown) for electrifying atomized paint sprayed from the rotary atomizing head 6.

The motor 3 drives the rotary shaft 4. In this embodiment, the motor 3 is a pneumatic motor, which comprises a body part 30, an air bearing 31 and the like.

The body part 30 is a structural member of the motor 3 and rotatably supports the rotary shaft 4 through the air bearing 31. Air is supplied to the air bearing 31 through an air supply passage 31*a*.

The rotary shaft 4, which is made of a hollow member, transmits rotary driving force of the motor 3 to the rotary atomizing head 6. An external thread is formed on a front end part (tip part) of an outer peripheral surface of the rotary shaft 4, and an internal thread is formed on an inner peripheral surface of a basal part 60, so as to screw the rotary atomizing head 6 onto the tip part of the rotary shaft 4.

A turbine 40 comprises blades formed on a rear end part (basal part) of the rotary shaft 4 so as to serve as a turbine 40, which is rotated by air from a compressor (not shown) so as to rotate the rotary shaft 4. The paint supply tube 5 relatively rotatably penetrates the rotary shaft 4.

Although the turbine 40 is formed on the rear end part of the rotary shaft 4 in this embodiment, the turbine 40 may alternatively be fixed on the rotary shaft 4 as a member separated from the turbine 40. In addition, although the rotary shaft 4 is rotated by the pneumatic motor 3 in this embodiment, the present invention is not limited to such a pattern. The rotary shaft 4 may alternatively be rotated by a hydraulic or electric motor.

Figure 2:
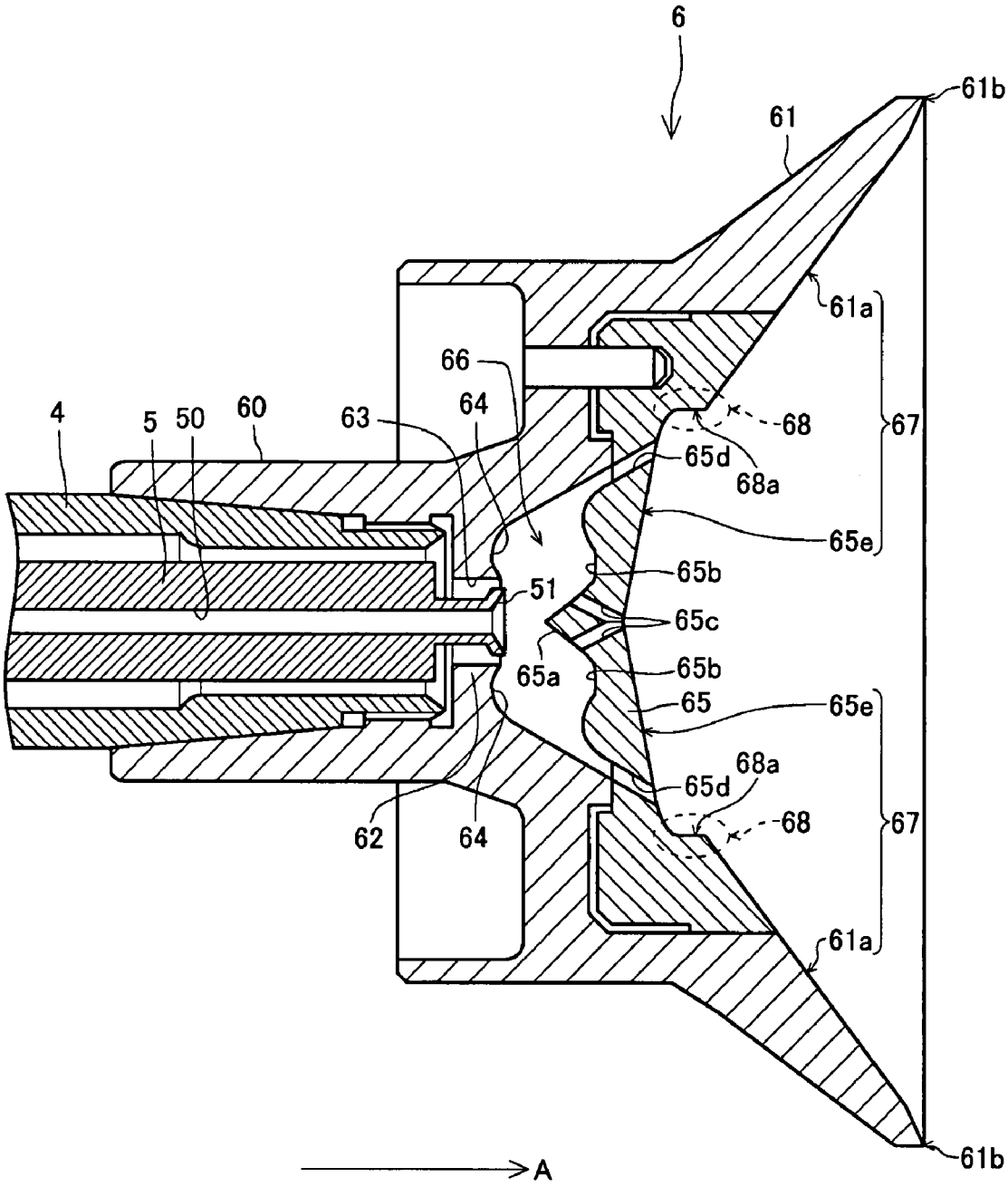
FIG. 2 is a sectional side view of a rotary atomizing head according to an embodiment of the present invention.

As shown in FIGS. 1 and 2, the paint supply tube 5 supplies paint to the rotary atomizing head 6.

In this embodiment, the paint supply tube 5 is a single tube, which is also used to supply solvent for washing paint adhering to the rotary atomizing head 6.

The paint supply tube 5 is a tube serving as a supply passage 50 for passing paint or solvent passes therethrough. A nozzle part 51 is formed at a tip part (front end part) of the paint supply tube 5. The nozzle part 51 is formed into a forwardly widened trumpet-shape.

A rear end part of the paint supply tube 5 is formed into a valve seat 52 and fixedly inserted into a tip part (front end part) of a connection tube 11. A rear end part of the connection tube 11 is fixed to the main body 2.

A rod-like needle valve 12 is inserted into the connection tube 11 so as to keep a predetermined distance from an inner wall of the connection tube 11. A tip part (front end part) of the needle valve 12 is needle-like shaped and can be fitted into the valve seat 52. A piston 12*a* is formed on a basal part (rear end part) of the needle valve 12 and is biased by a spring 13 so as to fit the tip part of the needle valve 12 into the valve seat 52.

A space in front of the piston 12*a* is connected to an air supply passage 14. By supplying compressed air to the space, the needle valve 12 is moved backward against the biasing force of the spring 13, whereby the needle valve 12 is separated from the valve seat 52.

A fluid supply passage 15 bored in the main body 2 is provided to connect containers (not shown), which store paints of various kinds respectively, and a paint switching device (not shown), which selects one of paints and solvent to be supplied to the rotary atomizing head 6, to the paint supply tube 5 (more strictly, the rear end part of the connection tube 11).

By operating (longitudinally moving) the needle valve 12, the fluid supply passage 15 is selectively connected to the paint supply tube 5 to supply paint or solvent to the rotary atomizing head 6, or separated from the paint supply tube 5 to isolate the supplied paint or solvent from the rotary atomizing head 6.

In addition, a control device (not shown) is provided to control the operation of the paint switching device, the power on/off of the motor 3, the adjustment of rotation speed of the motor 3, and the operation of the needle valve 12.

Explanation will be given on a detailed construction of the rotary atomizing head 6 according to FIGS. 1 and 2.

The rotary atomizing head 6 in this embodiment mainly comprises the basal part 60, a diametrically expanded part 61, a partition 62 and a blocking member 65.

The basal part 60 serving as a rear half of the rotary atomizing head 6 is substantially circularly cylindrical. The basal part 60 is formed on the inner peripheral surface thereof with the internal thread so as to screw the rotary atomizing head 6 onto the tip part of the rotary shaft 4. When the rotary shaft 4 is rotated, the rotary atomizing head 6 is also rotated.

The diametrical expanded part 61 serving as a front half of the rotary atomizing head 6 is formed into a trumpet-shape. An inner wall surface 61*a* of the diametrical expanded part 61 is diametrically expanded from the center the diametrical expanded part 61 to a peripheral edge 61*b*.

The partition 62 is provided at the boundary between the diametrical expanded part 61 and the basal part 60. A through hole 63 is formed in a substantially center portion of the partition 62. A paint gallery 64 recessed backward is formed at the peripheral edge of the through hole 63, that is, on the periphery of the nozzle part 51 of the paint supply tube.

The blocking member 65 is a substantially discoid member and covers the center of the inner wall surface 61*a* of the diametrical expanded part 61. An atomizing chamber 66 is a space surrounded by the center of the inner wall surface 61*a* and the blocking member 65. Paint or solvent is supplied to the atomizing chamber 66 through the paint supply tube 5.

A substantially conical projection 65*a* is formed at the center of the rear surface of the blocking member 65 which faces the atomizing chamber 66. A recess 65*b* is formed at the peripheral edge of the projection 65*a* and is depressed forward. A center connection hole 65*c* communicates the middle portion of the projection 65*a* with a center of a front surface 65*e* of the blocking member 65. Paint supply holes 65*d* are provided at a boundary between the projection 65*a* and the peripheral edge of the blocking member 65 so as to communicate the inside and the outside of the atomizing chamber 66 with each other along the inner wall surface 61*a*. The paint supply holes 65*d* supply paint or solvent to a later-discussed inner peripheral surface 67.

The inner peripheral surface 67 constitutes the front surface of the rotary atomizing head 6 and is diametrically expanded from the center of the rotary atomizing head to the peripheral edge 61*b*. In this embodiment, the inner peripheral surface 67 comprises the front surface 65*e* of the blocking member 65 and the part of the inner wall surface 61*a* not facing the atomizing chamber 66.

The paint or solvent supplied to the atomizing chamber 66 through the paint supply tube 5 is further supplied to the inner peripheral surface 67 through the paint supply holes 65*d*.

By rotating the rotary atomizing head 6, centrifugal force is applied on the paint supplied to the inner peripheral surface 67. The paint moves to the peripheral edge 61*b* along the inner peripheral surface 67 and is discharged outside atomizingly.

A step part 68 is formed at the middle portion of the inner peripheral surface 67 between the paint supply holes 65*d* and the peripheral edge 61*b*. The step part 68 has a step surface which is substantially perpendicular to the direction of centrifugal force applied on the paint supplied to the inner peripheral surface 67 (the direction substantially perpendicular to the arrow A).

With regard to the rotary atomizing head 6, which is the embodiment of the rotary atomizing head according to the present invention, the inner peripheral surface 67 diametrically expanded from the center of the rotary atomizing head to the peripheral edge 61*b* is formed and centrifugal force generated by the rotation is applied on the paint supplied to the inner peripheral surface 67 so as to discharge the paint outside atomizingly, and the step part 68 is formed at the middle portion of the inner peripheral surface 67 between the paint supply holes 65*d*, supplying paint or solvent to the inner peripheral surface 67, and the peripheral edge 61*b* of the inner peripheral surface 67.

With regard to the rotary atomizing coating machine 1, which is the embodiment of the rotary atomizing coating machine according to the present invention, the rotary atomizing coating machine has the rotary atomizing head 6 constructed so that the inner peripheral surface 67 diametrically expanded from the center of the rotary atomizing head to the peripheral edge 61*b* which is formed and centrifugal force generated by the rotation is applied on the paint supplied to the inner peripheral surface 67 so as to discharge the paint outside atomizingly, and the step part 68 is formed at the middle portion of the inner peripheral surface 67 between the paint supply holes 65*d*, supplying paint or solvent to the inner peripheral surface 67, and the peripheral edge 61*b* of the inner peripheral surface 67.

The construction takes below effects.

Figure 3:
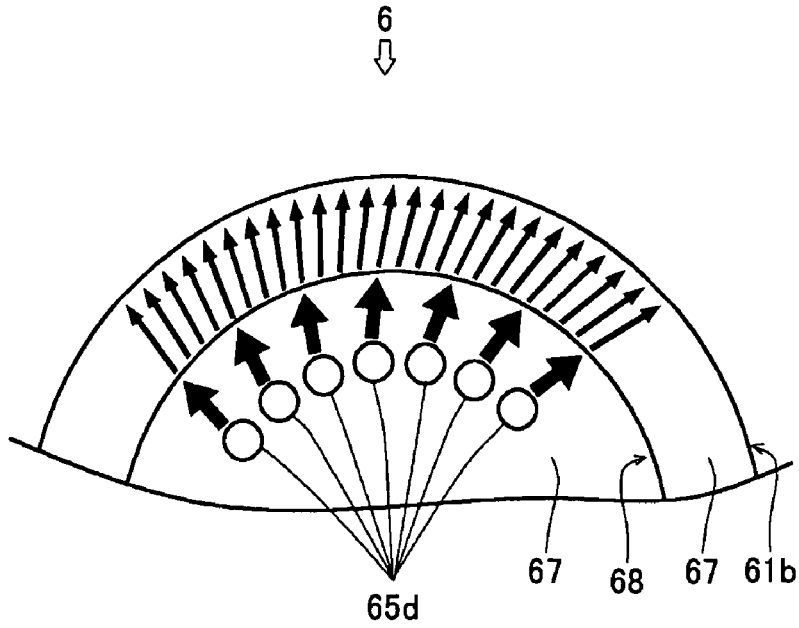
FIG. 3 is a schematic drawing of the route of paint moving on the inner peripheral surface of the rotary atomizing head.
Figure 3:
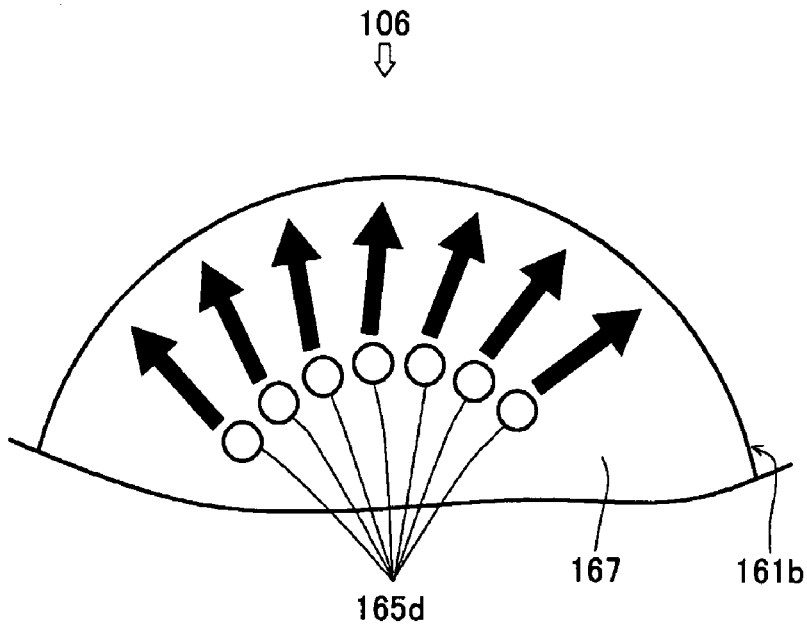

With regard to a conventional rotary atomizing head 106 shown in FIG. 3 (B), any step part is not formed at a middle portion of an inner peripheral surface 167 between paint supply holes 165*d* and a peripheral edge 161*b* of the inner peripheral surface 167.

Accordingly, when the rotary speed of the rotary atomizing head 106 is increased or viscosity of paint is high, paint supplied from the paint supply holes 165*d* to the inner peripheral surface 167 is moved within quite shallow parts on lines connecting the paint supply holes 165*d* to the corresponding points on the peripheral edge 161*b* of the inner peripheral surface 167, and is not spread on the inner peripheral surface of the rotary atomizing head 106 uniformly.

Therefore, when the paint is discharged outside atomizingly from the peripheral edge 161*b*, the particle size of the paint is not uniform, thereby deteriorating the quality of coating.

When the hardness of pigment included in the paint is high, the specific parts of the inner peripheral surface 167 on which the paint moves wear out. As a result, it is difficult to lengthen the life of the rotary atomizing head 106. For preventing the wearing of the specific parts, it is necessary to construct the rotary atomizing head 106 by hardwearing material such as ceramic or titanium or to form a plating layer with hard material on the corresponding parts of the inner peripheral surface 167. Therefore, it is difficult to produce the rotary atomizing head 106 cheaply.

Furthermore, since paint moves on the specific parts of the inner peripheral surface 167, the amount of wearing of the rotary atomizing head 106 per operating time is increased, whereby the paint may be contaminated with wearing powder so as to cause the failure of paint.

To the contrary, with regard to the rotary atomizing head 6 of this embodiment shown in FIG. 3 (A), the step part 68 is formed at the middle portion of the inner peripheral surface 67 between the paint supply holes 65*d* and the peripheral edge 61*b* of the inner peripheral surface 67.

Accordingly, even if the rotary speed of the rotary atomizing head 6 is increased or viscosity of paint is high, paint supplied from the paint supply holes 65*d* to the inner peripheral surface 67 is dammed up once by the step part 68 and spread on the step part 68 uniformly in the middle of the movement, and then gets over the step part 68 and moves to the peripheral edge 61*b*.

As a result, the paint moving within the part of the inner peripheral surface 67 between the paint supply holes 65*d* and the peripheral edge 61*b* is spread on the whole part thinly. Accordingly, when the paint is discharged outside atomizingly from the peripheral edge 61*b*, the particle size of the paint is uniform, thereby improving the quality of coating.

Even if the hardness of pigment included in the paint is high, the paint moves spreadingly uniformly on the inner peripheral surface 67 so as to prevent the specific parts of the inner peripheral surface 67 on which the paint moves from wearing out, thereby lengthening the life of the rotary atomizing head 6. Collaterally with it, it is not necessary to construct the rotary atomizing head 6 by hardwearing material such as ceramic or titanium or to form a plating layer with hard material on the corresponding parts of the inner peripheral surface 67 so as to prevent the wearing of the specific parts, whereby the rotary atomizing head 6 can be produced cheaply.

Furthermore, since the paint moves spreadingly uniformly on the inner peripheral surface 67, the amount of wearing of the rotary atomizing head 6 per operating time is reduced, whereby the paint is prevented from being contaminated with wearing powder so as to cause the failure of paint.

In addition, a step surface 68*a* of the step part 68 is preferably substantially perpendicular to the direction of centrifugal force applied on the paint supplied to the inner peripheral surface 67. According to this, paint is certainly dammed up once so as to spread the paint on the inner peripheral surface 67 uniformly.

For preventing wearing of the inner peripheral surface 67, the step part 68 is preferably provided near the paint supply holes 65*d* in the middle portion of the inner peripheral surface 67 between the paint supply holes 65*d* and the peripheral edge 61*b* of the inner peripheral surface 67.

Two or more step parts may be provided in the middle portion of the inner peripheral surface between the paint supply holes and the peripheral edge of the inner peripheral surface.

INDUSTRIAL APPLICABILITY

The present invention can be used for a rotary atomizing head or a rotary atomizing coating machine having a rotary atomizing head.

The invention claimed is:

1. A rotary atomizing head comprising:

an inner peripheral surface having: a diametrical expanded part diametrically expanded from a center of the rotary atomizing head to a peripheral edge; and a blocking member covering the center of the diametrical expanded part, such that centrifugal force generated by rotation is applied on paint supplied to the inner peripheral surface so as to discharge the paint outside atomizingly, wherein a single step part provided at a middle portion of the inner peripheral surface between paint supply holes, supplying paint to the inner peripheral surface, and the peripheral edge of the inner peripheral surface, the single step part comprising a step surface substantially perpendicular to a direction of centrifugal force applied on the paint supplied to the inner peripheral surface, and a distance between each of the paint supply holes and the step part being shorter than a distance between the step part and the peripheral edge, the step part provided between the paint supply holes disposed at the blocking member and a peripheral edge of the blocking member, and a distance between the step part and the paint supply holes is shorter than a distance between the step part and the peripheral edge of the blocking member, and an inner surface of the blocking member formed between the step part and the peripheral edge of the blocking member, and an inner surface of the diametrical expanded part, being configured as a continuous surface.

2. The rotary atomizing head of claim 1, wherein the inner peripheral surface extends substantially linearly from the single step part to nearly the peripheral edge.

3. A rotary atomizing coating machine comprising:

a rotary atomizing head having an inner peripheral surface having: a diametrical expanded part diametrically expanded from a center of the rotary atomizing head to a peripheral edge; and a blocking member covering the center of the diametrical expanded part, such that centrifugal force generated by rotation is applied on paint supplied to the inner peripheral surface so as to discharge the paint outside atomizingly, wherein a single step part provided at a middle portion of the inner peripheral surface between paint supply holes, supplying paint to the inner peripheral surface, and the peripheral edge of the inner peripheral surface, the single step part comprising a step surface substantially perpendicular to a direction of centrifugal force applied on the paint supplied to the inner peripheral surface, and a distance between each of the paint supply holes and the step part being shorter than a distance between the step part and the peripheral edge, the step part provided between the paint supply holes disposed at the blocking member and a peripheral edge of the blocking member, and a distance between the step part and the paint supply holes is shorter than a distance between the step part and the peripheral edge of the blocking member, and an inner surface of the blocking member formed between the step part and the peripheral edge of the blocking member, and an inner surface of the diametrical expanded part, being configured as a continuous surface.

4. The rotary atomizing coating machine of claim 3, wherein the inner peripheral surface extends substantially linearly from the single step part to nearly the peripheral edge.

* * * * *